United States Patent [19]

Buzzi

[11] Patent Number: 4,742,787

[45] Date of Patent: May 10, 1988

[54] HOOK DRIVE FOR CHAIN STITCH SEWING MACHINES, PARTICULARLY FOR HAND-HOLDABLE ONES

[75] Inventor: Ricardo Buzzi, Milan, Italy

[73] Assignee: Metalplast S. r. l., Italy

[21] Appl. No.: 73,845

[22] Filed: Jul. 15, 1987

Related U.S. Application Data

[63] Continuation-in-part of Ser. No. 851,277, Apr. 10, 1986, abandoned, which is a continuation of Ser. No. 655,501, Sep. 27, 1984, abandoned.

[30] Foreign Application Priority Data

Jul. 10, 1983 [IT] Italy ..... 23187 A/83

[51] Int. Cl.[4] ..... D05B 1/06

[52] U.S. Cl. ..... 112/162; 112/169; 112/199

[58] Field of Search ..... 112/122.1, 129, 162, 112/169, 197, 199, 201, 269.1

[56] References Cited

U.S. PATENT DOCUMENTS

| | | | |
|---|---|---|---|
| 407,286 | 7/1889 | Fefel | 112/269.1 X |
| 2,639,683 | 5/1953 | Huntington | 112/169 |
| 2,829,612 | 4/1958 | Schwartz | 112/162 |
| 3,257,979 | 6/1966 | Michaud | 112/129 X |

*Primary Examiner*—Wm. Carter Reynolds
*Attorney, Agent, or Firm*—Stefan J. Klauber

[57] ABSTRACT

A hook drive for chain stitch sewing machines, in particular for those suited to be hand-held, which comprises an upper hook and a lower hook of curvilinear configuration having a hook holding shank supported obliquely in a box-like case. Each hook is connected to a drive including a gear whereto one end of a swinging yoke is articulated eccentrically which has the opposite end pivoted centrally to a block made rigid with a respective one of said shanks. The two driving gears, one of which is connected to a drive shaft, are in meshing engagement with each other and with a third gear which may drive a movable cutter blade.

4 Claims, 3 Drawing Sheets

HOOK DRIVE FOR CHAIN STITCH SEWING MACHINES, PARTICULARLY FOR HAND-HOLDABLE ONES

This application is a continuation-in-part of abandoned application Ser. No. 851,277, filed Apr. 10, 1986, which is a continuation of abandoned application Ser. No. 655,501, filed Sept. 27, 1984.

BACKGROUND OF THE INVENTION

This invention relates to a hook drive for chain stitch sewing machines, in particular.

Chain stitch sewing machines are used for joining together abutting cloth edges in various fields of industrial finishing. Such machines are generally equipped with a movable cutter blade placed in front of a sewing needle to cut a cloth prior to sewing, and are accordingly also known as "cutter" or "overcast" sewing machines.

In a machine of the above general type, the motion of the two hooks follows a rectilinear back-and-forth pattern. This involves disadvantages both of constructional and functional characters. The construction of such machines is bulky and requires a high number of component parts for operating the hooks. This results, in turn, in increased manufacturing costs and a heavier machine. Functionwise, moreover, the reciprocating hooks fall short of providing those movement accelerations and decelerations which would ensure faultless formation of the stitches even at high sewing speeds, as is presently required by the industry.

SUMMARY OF THE INVENTION

It is a primary object of this invention to provide a hook drive for sewing machines of the type specified above which can afford, on the one side, a highly compact and lightweight construction of the machine, and on the other side, hook movements which, by being controlled mechanically, can take place at suitably increasing and decreasing velocities along the path thereof, thus providing a highly reliable operation even at very high sewing speeds.

This object is achieved, according to the invention, by providing a hook drive for chain stitch sewing machines as indicated, which comprises within a hand-holdable case, a motor and related drive, two hooks operative to form the loop and knot of a chain stitch and, which hook drive is characterized:

- in that an upper hook and a lower hook are provided having a curvilinear configuration and a hook holding shank for supporting said hooks obliquely in a box-like supporting case;
- in that each of said hooks is operated through a drive including a gear having one end of a swinging yoke articulated eccentrically thereto, the opposite end of said swinging yoke being hingedly connected centrally to a block rigidly connected with a respective one of said hook shanks; and
- in that said two driving gears, one of which is connected to a drive shaft, are in meshing engagement with each other, and preferably, also with a third gear.

Further according to this invention, the shanks of the curvilinear hooks are supported in the box-like case with an oblique setting relatively to both the vertical transverse plane and vertical longitudinal plane of said case, the axes of said shanks also intersecting the longitudinal axis of the respective gear.

With the hook drive proposed, the required decelerations and accelerations on the hook paths are advantageously achieved in a most reliable fashion since these are coercively, that is mechanically, determined by the very configuration of the proposed drive.

Additionally to providing a highly reliable operation, this affords very high sewing speeds. A further advantage resides then in the proposed drive enabling the sewing pitch to be increased up to 7–8 mm in length, thereby bringing about a significant saving in yarn even with a long overcast stitch which spans a very long cloth section, e.g. 20 mm long.

Along the hook paths of movement, made curvilinear according to the invention with an angular extension of about 90°, provision is expediently made for a marked slow-down at the hook crossing point for yarn transfer, as well as for a high transport rate of the yarn and maximum slowing at the needle intersect point, which in combination with a slow-down during the final portion of the needle downward travel gives full assurance of a faultless formation of the stitches.

BRIEF DESCRIPTION OF THE DRAWINGS

Further features, details, and advantages of the hook drive of this invention will be more readily understood from the following description of a preferred embodiment thereof, given herein by way of example with reference to the accompanying drawings, wherein.

DESCRIPTION OF A PREFERRED EMBODIMENT

Figure 1:
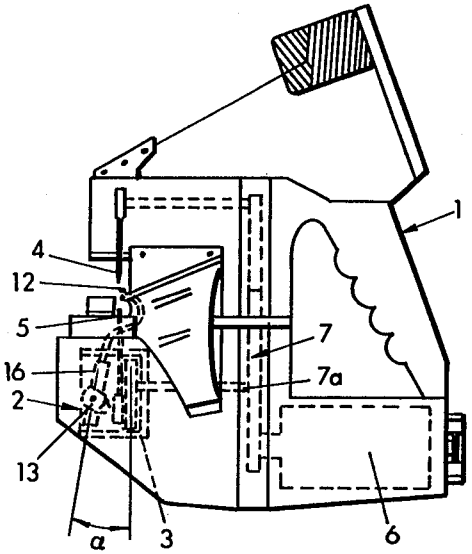
FIG. 1 is a diagrammatic side elevation of a hand-holdable sewing machine incorporating a hook drive according to the invention.

Schematically indicated at 1 in FIG. 1 is a hand-holdable stitch sewing machine incorporating the hook drive according to this invention, as generally designated with the reference numeral 2, and accommodated within a box-like case 3. Indicated at 4 and 5 are the machine needle and a moving cutter blade, respectively, the numeral 5a designating the cutter anvil blade, which is secured to the case 3 by screws, and the numerals 6 and 7 designating a motor and related drive system, wherein the drive shaft is indicated at 7a. The cutter 5 has a body which is guided in a channel defined by portions of case 3 adjacent to cutter anvil blade 5a so that the cutter is free to reciprocate but is laterally restrained and allowed to undergo only limited lateral movement. The latter shaft is rotated in a counterclockwise direction and is keyed to a middle gear 8 meshing with two side gears 9 and 10, said gears having an equal number of teeth and are carried coplanarly inside the case 3. As shown in FIGS. 2, 3, 4, 5 and 6, at 11 and 12, there are indicated a lower hook and an upper hook relative to their paths of movement across a material being sewn. The hook 11 is driven by the gear 9, and the hook 12 by the gear 8. The gear 10 controls the moving cutter blade 5 through cam-like parts shown in detail in FIGS. 2 and 6.

Figure 2:
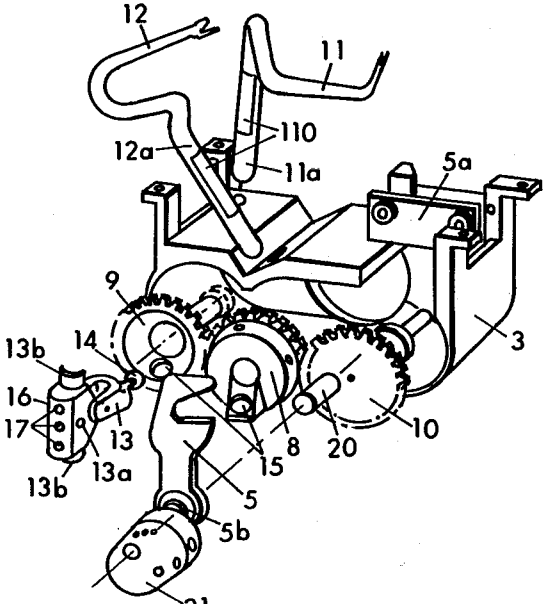
FIG. 2 is an exploded view of the component parts of the inventive hook drive.

According to the invention, control of the hooks 11,12 is achieved by the gears 8 and 9 by an intervening swinging yoke 13 of U-like configuration (see FIG. 2). The yoke has a ball-like rear end 14 received in a seat 15 which is formed on each one of gears 8 and 9 in an eccentric fashion, the front end of the swinging yoke 13 being pivotally secured at 13a to a supporting block 16 having end portions or abutments 13b (see FIG. 2) which is fastened, in the embodiment shown in FIGS. 2, 3, 4, 5 and 6 through screws 17, to an associate holding shank 11a,12a of the hook 11,12, the screws 17 engaging with lands 110 with the shanks 11a and 12a being received in bores 16b in blocks 16 In accordance with this invention, as seen particularly in FIGS. 7 and 7a, the shanks 11a and 12a enter case 3 through apertures 11b and 12b, respectively, and their ends extend through apertures 11c and 12c, respectively, so that their axes obliquely intersect the longitudinal axes of the associated gears 8,9. For each shank 11a, 12a, the oblique setting is twofold, namely both on the vertical longitudinal plane of the supporting case 3 (see alpha in FIG. 1) and the vertical transverse plane (see B in FIG. 3). Thus, with the construction just described, the continuous rotary motion of the gears 8 and 9 is converted into a reciprocating oscillatory motion of the hooks 11 and 12 to an angular amplitude of about 90 degrees see FIGS. 3a, 4a, 5a, and 6a.

Figure 7:
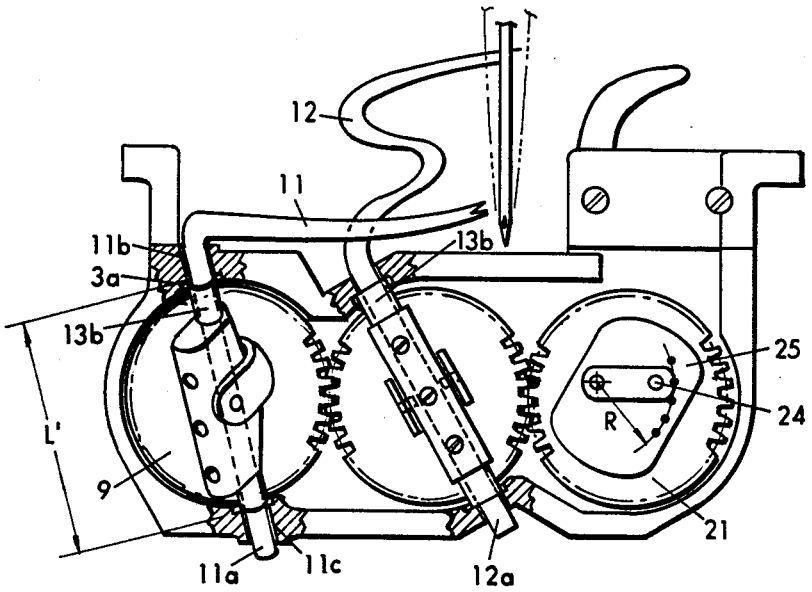
FIG. 7 is a fragmentary side elevational view, partially in section of the machine shown in FIG. 3, illustrating the mounting of the hooks.
Figure 7A:
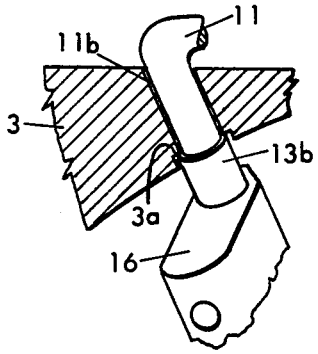
FIG. 7*a* is a fragmentary detail view of a portion of FIG. 7.
Figure 8:
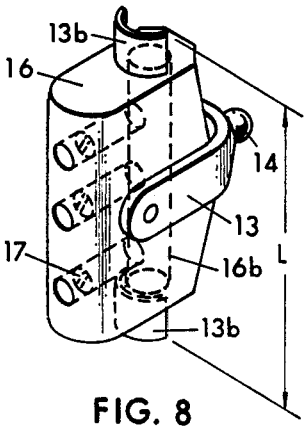
FIG. 8 is a perspective view of the yoke shown in FIG. 7.
Figure 9:
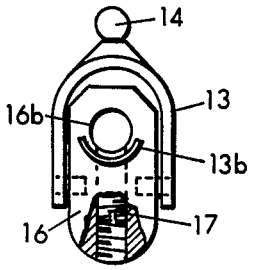
FIG. 9 is a plan view of the yoke illustrated in FIG. 8.

Again referring particularly to FIGS. 7 and 7a, each hook-supporting block 16, as mentioned, has end portions or abutments 13b which are generally semi-cylindrical in shape. End portions 13b are received in shallow circular recesses 3a which surround the inner ends of apertures 11b, 11c, 12b and 12c so that the blocks 16 are free to turn but, the end portions 13b give the blocks 16 an overall length of L' and since the end portions 13b essentially abut the case 3 as their ends ride in recesses 3a and are thus restrained against axial movement, and since the hooks 11 and 12 are rigidly held in blocks 3 by screws 17, the hooks 11 and 12 are similarly held against axial movement. Spring washers, (not shown) may be seated in one or both sets of recesses 3a to engage end portions 13b, to provide further restraint against axial movement and to facilitate assembly.

According to the invention, with the interposition of the swinging yoke 13 between a gear and associated oblique shank 11a, 12a of the hooks 11, 12, pivoted at one end frontally at 13a to the center portion of the supporting block 16 and at the rear end 14 in an eccentric fashion (received in seat 15) to the gear 8,9, desired accelerations and decelerations along the hook paths are achieved in a most reliable manner, in that they are mechanically induced, as provided by the invention and made feasible by the continuous variation of the entraining yoke lever arm between the gear 8,9 and associated shank 11a,12a of the hook 11,12. In fact, with the proposed drive, there occurs a significant shortening of the lever arm with the swinging yoke in its fully swung position and with the hooks 11 and 12 at their highest speeds of curvilinear motion, whereas, on a successive 90° rotation of the swinging yoke, the lever arm will be lengthened, a progressive and regressive coupling to the radius thus occurring during the gear rotation, and consequently and as outlined in (FIGS. 6 and 6a), maximum slowing down of the tips of the hooks 11 and 12. Maximum slowing down of the hooks 11 and 12 will also occur upon their reaching the point of mutual crossing (FIGS. 4 and 4a).

Figure 6:
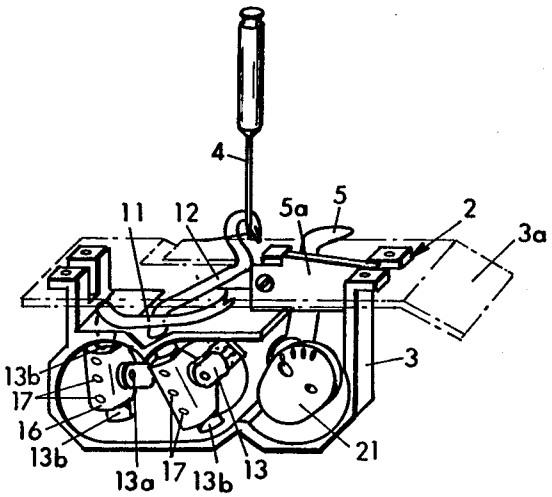
FIG. 6 is a perspective view of portions of the machine shown in FIGS. 1 and 2, showing the hooks in a still further position.
Figure 6A:
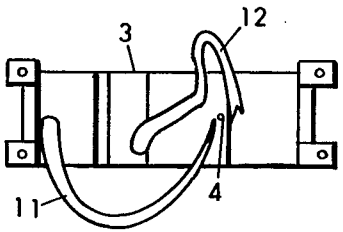
FIG. 6*a* is a top plan view of the frame and hooks as seen in FIG. 6.

By virtue of the synchronization made possible by the proposed drive, the gear 9 is enabled to control with but one revolution a complete to-and-fro cycle of the hook 11. Thus, the latter (hook 11) is enabled to perform a rapid yarn pick-up under the plate 3a upon the needle 4 being returned upwards, and a successive fast transport of the yarn 18 is allowed with maximum slowing down of said hook 11 at the forward travel limit thereof or point of crossover with the upper hook 12 (FIG. 4). In turn, the hook 12 will pick up the yarn from the hook 11 and take it to a location above the material being sewn, as previously cut by the blades 5 and 5a, to then slack off until the needle 4 penetrates, in its downward stroke, the loop formed by said hook 12 at the top travel limit (FIG. 6).

Figure 3:
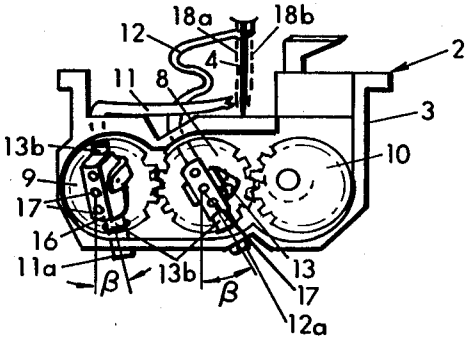
FIG. 3 is a diagrammatic side view of some of the components shown in FIG. 2 but in assembled form.
Figure 3A:
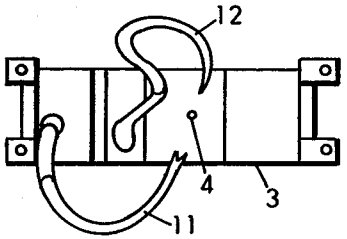
FIG. 3*a* is a plan view of the frame and hooks as seen in FIG. 3.
Figure 4:
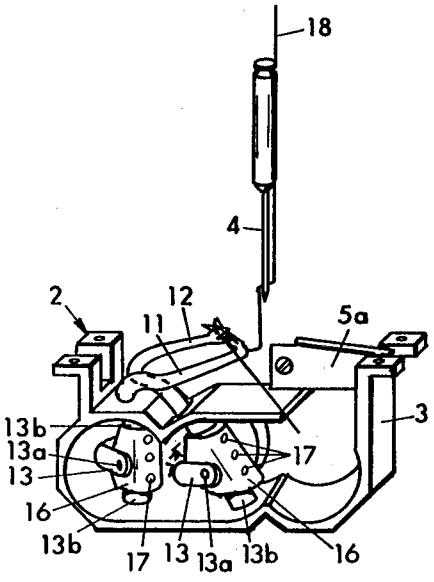
FIG. 4 is a perspective view corresponding to parts shown in FIG. 3 but showing the hooks in different position.

Shown in FIGS. 3 and 3a 4 at its bottom travel limit position and the sideward yarn portions 18a and 18b under tension. As the needle 4 begins then to move upwards, the lower hook 11 will contact the conventional loop formed in the proximity of the needle eye.

Figure 5:
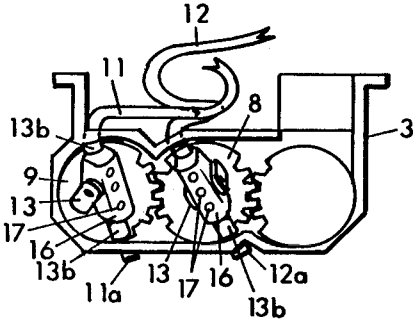
FIG. 5 is a side elevational view of portions of the machine shown in FIG. 3 showing the hooks in another position.
Figure 5A:
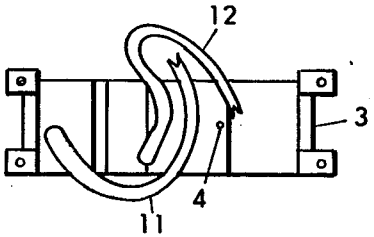
FIG. 5*a* is a top plan view of the frame and hooks as seen in FIG. 5.
Figure 4A:
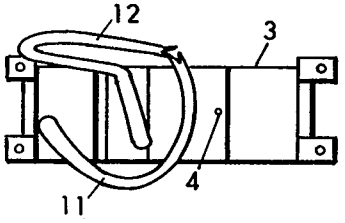
FIG. 4*a* is a plan view of the frame and hooks as seen in FIG. 4.

FIGS. 4 and 4a shows the crossover position of the hooks, and FIGS. 5 and 5a illustrate the hook positions as the needle starts its downward stroke after reaching the top travel limit position. For completeness sake, FIG. 2 shows the linkage actuating the moving cutter blade, which affords faultless cutting conditions and quick blade replacement features. Thus the movable blade 5 is received on a pin 20 carried by gear 10 and which passes through an aperture 5b to engage with a disc-like member 21 which holds it on pin 20

A highly satisfactory operation has been achieved by imparting the shanks 11a and 12a with the following inclination values:

| Angle α (FIG. 1) (formed by the shank with the case vertical longitudinal plane) | Angle β (FIG. 3) (formed by the shank with the case transverse plane) |
|---|---|
| For hook 11: | |
| 7° to 8°, preferably 7° 30' | 6° to 8°, preferably 7° |
| For hook 12: | |
| 6° to 8°, preferably 7°. | 30° to 38°, preferably 34°. |

It may be appreciated from the foregoing description that the hook drive of this invention effectively achieves its objects and can secure the advantages set forth hereinabove.

In practicing the invention, all of the parts may be replaced with other technically and/or functionally equivalent parts without departing from the protection scope of the instant invention.

I claim:

1. A hook drive for chain stitch sewing machines, in particular for one adapted to be hand-held, comprising a hand-holdable case and, disposed within said hand-holdable case:

a driving motor;

a drive system associated with said motor, including a drive shaft; and two hooks for forming the loop and knot in a chain stitch, including an upper hook and a lower hook, each having a curvilinear configuration and a hook holding shank supported obliquely in said case; and wherein i. there is provided a drive system accommodated in said case for operating each of said hooks, said drive system including a driving gear for each hook, a swinging yoke having one end eccentrically articulated like a universal joint to the driving gear, a block hingedly connected at its center to the opposite end of said swinging yoke, said block being rigidly secured to a hook shank, whereby said hook shanks are supported in an axially non-displaceable manner in said case;

ii. one of said driving gears for said hooks is connected to said drive shaft and said gears are in meshing engagement with each other;

iii. a third gear is in meshing engagement with one of said gears supporting a hook shank, and iv. said three gears are arranged coplanarly.

2. A hook drive according to claim 1, wherein the shanks of said hooks are supported in said case obliquely to both the vertical transverse plane and vertical longitudinal plane of said case, the axes of said hook shanks also intersecting the longitudinal axes of said gears.

3. A hook drive according to claim 2 wherein the inclination angle of the shank of one of said hooks relative to the longitudinal plane of said case is from 6° to 8° and the inclination angle of said hook shank relative to the transverse plane of said case is from 30° to 38°.

4. A hook drive according to claim 3 wherein the inclination angle of the other of said hook shanks relative to the longitudinal plane of said case is from 7° to 8° and the inclination angle of said hook shank relative to the transverse plane of said case is from 6° to 8°.

* * * * *